US008075220B1

(12) United States Patent
Suljevic

(10) Patent No.: US 8,075,220 B1
(45) Date of Patent: Dec. 13, 2011

(54) CURB COVERING DEVICE

(76) Inventor: Asmir Suljevic, Wickliffe, OH (US)

( * ) Notice: Subject to any disclaimer, the term of this patent is extended or adjusted under 35 U.S.C. 154(b) by 0 days.

(21) Appl. No.: 12/765,692

(22) Filed: Apr. 22, 2010

(51) Int. Cl.
*E01C 11/22* (2006.01)

(52) U.S. Cl. ..... 404/4; 404/2

(58) Field of Classification Search ..... 404/2–4, 404/8

See application file for complete search history.

(56) References Cited

U.S. PATENT DOCUMENTS 1,192,506 A 7/1916 Davis
1,245,689 A 11/1917 Davis
1,659,830 A 2/1928 Moyer
1,909,551 A 5/1933 Ross
2,033,028 A * 3/1936 Gaisman ..... 404/8
3,520,082 A * 7/1970 Smith ..... 47/33
3,663,808 A 5/1972 Baatz
3,762,113 A * 10/1973 O'Mullan et al. ..... 52/102
3,957,383 A * 5/1976 Fredericks ..... 404/8
4,443,981 A * 4/1984 Weiss ..... 52/155
6,017,166 A * 1/2000 Mossburg, Jr. ..... 404/5
D426,000 S 5/2000 Jonasz
6,485,226 B1 * 11/2002 Harger ..... 404/7
6,776,556 B2 * 8/2004 Hessner ..... 404/44
7,186,053 B2 3/2007 Detzel
7,438,499 B1 * 10/2008 Romano et al. ..... 404/75

* cited by examiner

*Primary Examiner* — Raymond Addie

(57) ABSTRACT

A curb covering device for covering a portion of a curb featuring a generally flat panel; a first folding line, a second folding line, and a third folding line, wherein the first folding line is positioned about halfway between the third side edge of the panel and the fourth side edge of the panel, the second folding line is positioned between the first folding line and the fourth side edge of the panel, and the third folding line is positioned between the third side edge of the panel and the first folding line. The folding lines function to allow the panel to be folded over the portion of the curb.

9 Claims, 5 Drawing Sheets

CURB COVERING DEVICE

FIELD OF THE INVENTION

The present invention is directed to an accessory for curbs for helping to protect vehicle wheels and tires from damage when parking next to the curbs.

BACKGROUND OF THE INVENTION

When parking (e.g., parallel parking) a vehicle, it is very easy to contact the vehicle's wheels or tires with the curb. This unfortunately can cause significant damage to the wheels or tires. The present invention features a curb covering device for covering a portion of a curb. The covering device helps prevent damage to the vehicle if the vehicle comes in contact with the curb. In some cases, the curb covering device may be useful for businesses such as restaurants with valet parking because the device can help prevent damage to the vehicle and potential lawsuits. Without wishing to limit the present invention to any theory or mechanism, it is believed that the curb covering device of the present invention is advantageous because it is lightweight and does not need to be permanently attached to the curb, making it portable and easy to install.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Referring now to FIGS. 1-6, the present invention features a curb covering device 100 for covering a portion of a curb. The covering device helps prevent damage to the vehicle if the vehicle comes in contact with the curb 101. Without wishing to limit the present invention to any theory or mechanism, it is believed that the curb covering device of the present invention is advantageous because it is lightweight and does not need to be permanently attached to the curb, making it portable and easy to install.

Figure 1:
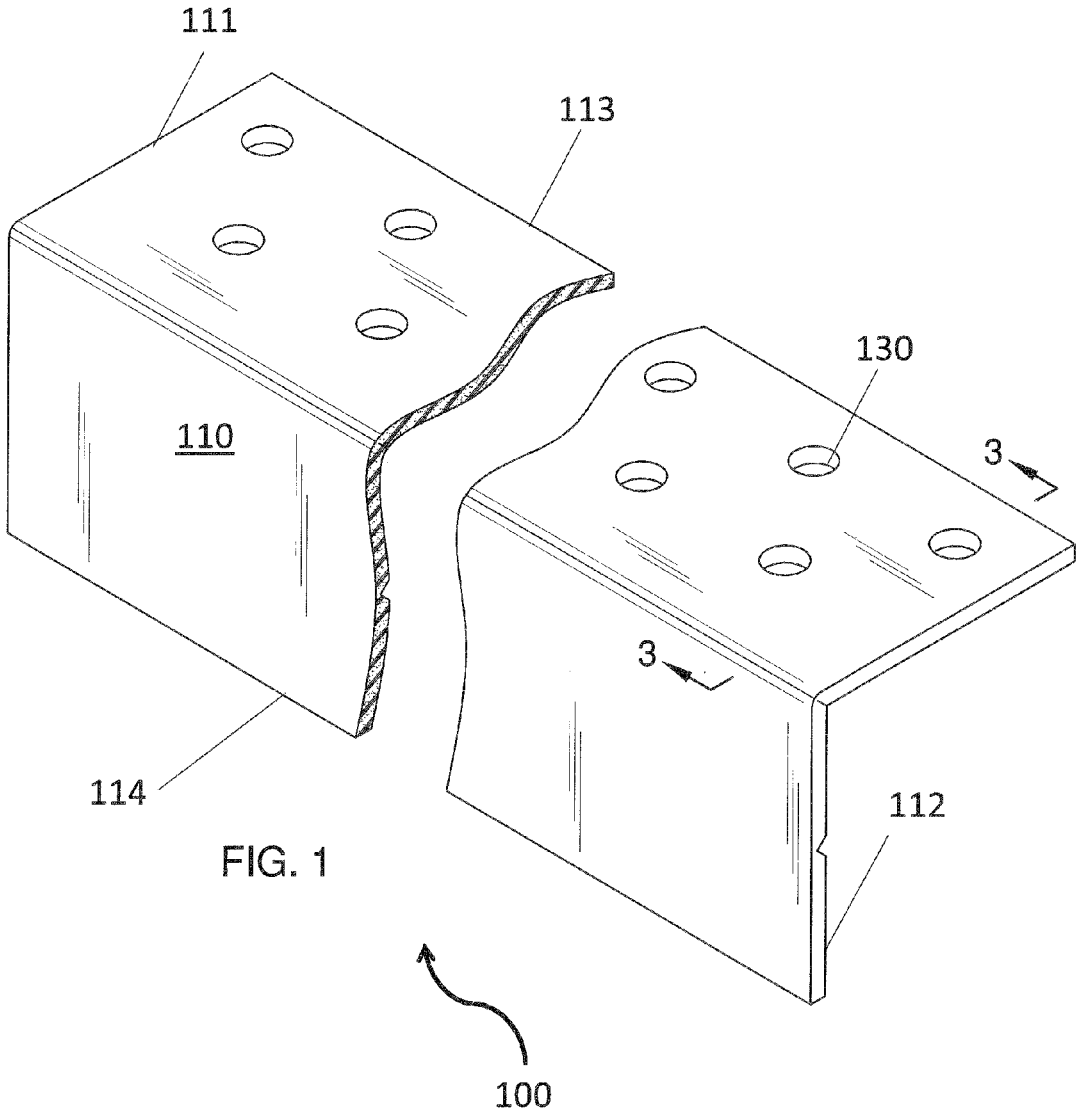
FIG. 1 is a front perspective view of the curb covering device of the present invention.
Figure 2:
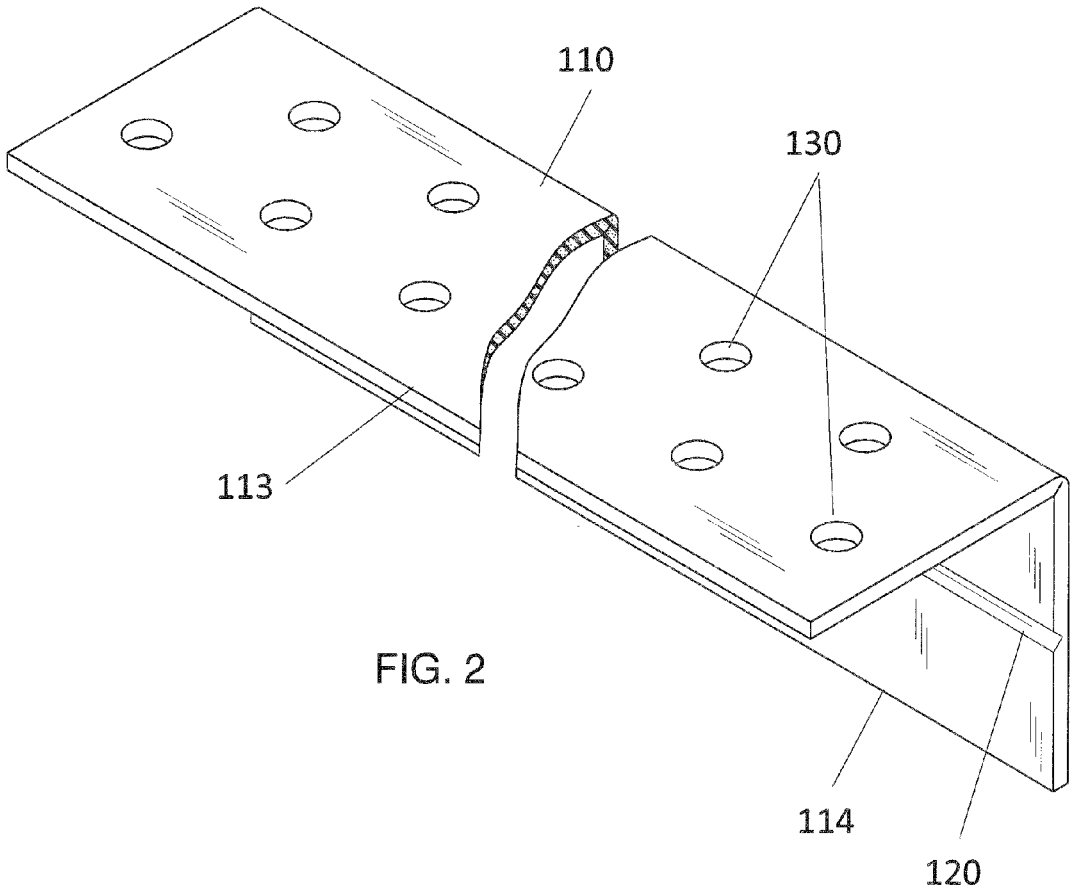
FIG. 2 is a rear perspective view of the curb covering device of FIG. 1.

As shown in FIG. 1 and FIG. 2, the curb covering device 100 comprises a generally flat panel 110 having a first side edge 111, a second side edge 112, a third side edge 113, a fourth side edge 114, a top surface, and a bottom surface. The panel 110 may be constructed from a variety of materials and in a variety of sizes. For example, in some embodiments, the panel 110 is between about 2 to 4 feet in width as measured from the first side edge 111 to the second side edge 112. In some embodiments, the panel 110 is between about 4 to 6 feet in width as measured from the first side edge 111 to the second side edge 112. In some embodiments, the panel 110 is between about 6 to 8 feet in width as measured from the first side edge 111 to the second side edge 112. In some embodiments, the panel 110 is more than about 8 feet in width.

In some embodiments, the panel 110 is between about 1 to 2 feet (e.g., 1.5 feet) in length as measured from the third side edge 113 to the fourth side edge 114. In some embodiments, the panel 110 is more than about 2 feet in length as measured from the third side edge 113 to the fourth side edge 114. In some embodiments, the panel 110 is between about 0.1 to 0.25 inches in thickness as measured from the top surface to the bottom surface. In some embodiments, the panel 110 is between about 0.25 to 0.5 inches in thickness as measured from the top surface to the bottom surface. In some embodiments, the panel 110 is between about 0.5 to 1.0 inches in thickness as measured from the top surface to the bottom surface. In some embodiments, the panel 110 is more than about 1 inch in thickness.

Disposed in the bottom surface of the panel 110 are one or more folding lines 120. The folding lines 120 are indentations in the bottom surface that run from the first side edge 111 to the second side edge 112. The folding lines 120 allow the panel 110 to be folded and thus securely fitted over a curb (see FIG. 5). In some embodiments, a first folding line is positioned about halfway between the third side edge 113 and the fourth side edge 114. In some embodiments, a second folding line is positioned between the first folding line and the fourth side edge 114. In some embodiments, a third folding line is positioned between the third side edge 113 and the first folding line. The present invention is not limited to these folding lines 120 and/or their positions. The various folding lines 120 allow the panel 110 to cover various sizes of curbs appropriately.

Figure 3:
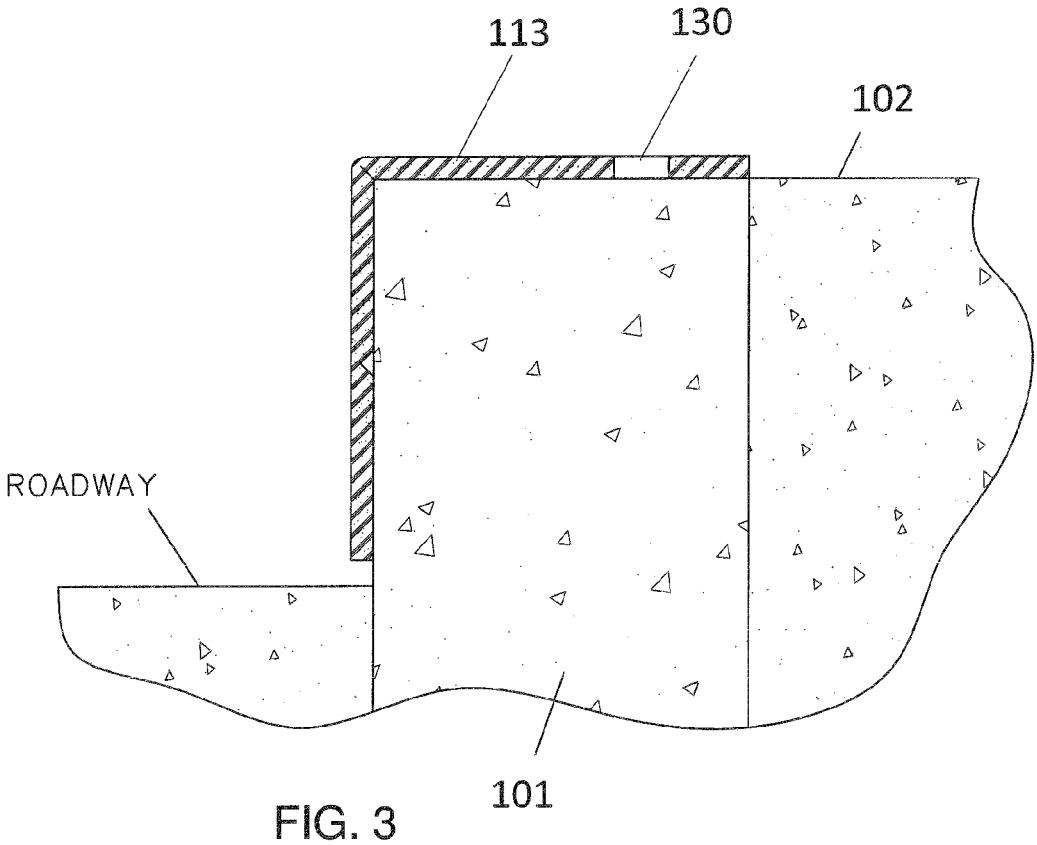
FIG. 3 is a side cross sectional view of the curb covering device of FIG. 1.
Figure 6:
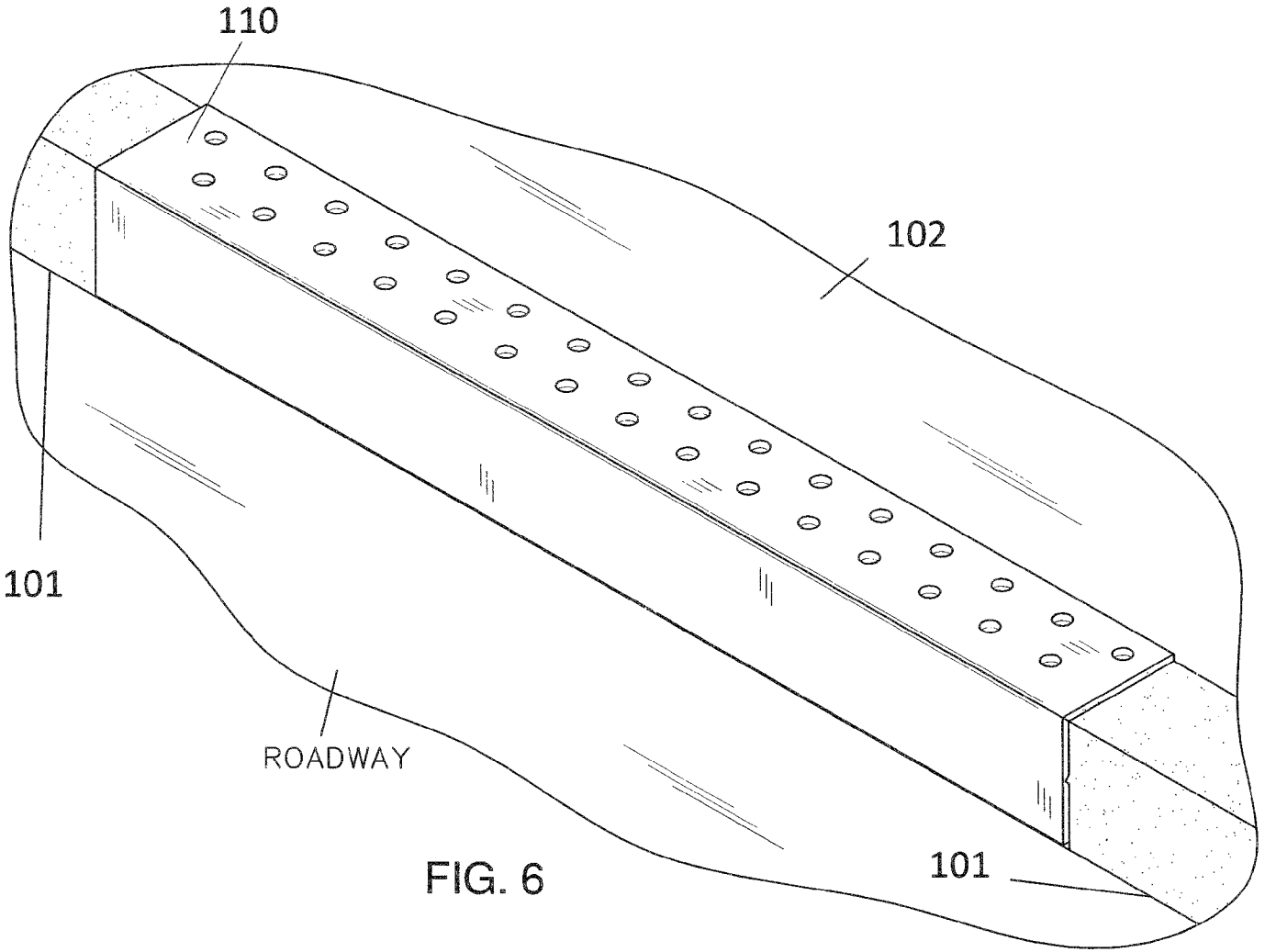
FIG. 6 is an in-use view of the curb covering device of the present invention.

The present invention also features a method of covering a portion of a curb. In some embodiments, the method comprises providing a curb covering device; bending the panel at either the first folding line, second folding line, or third folding line; and folding the panel over the portion of the curb. FIG. 3 and FIG. 6 show views of the curb covering device 100 of the present invention mounted on a curb 101 and sidewalk 102. The panel 110 is bent at a folding line (e.g., the first folding line).

The device 100 of the present invention is constructed from materials that are tough and durable. In some embodiments, the panel 110 is designed with two-tone color, although the panel 110 can be constructed in any design.

Figure 4:
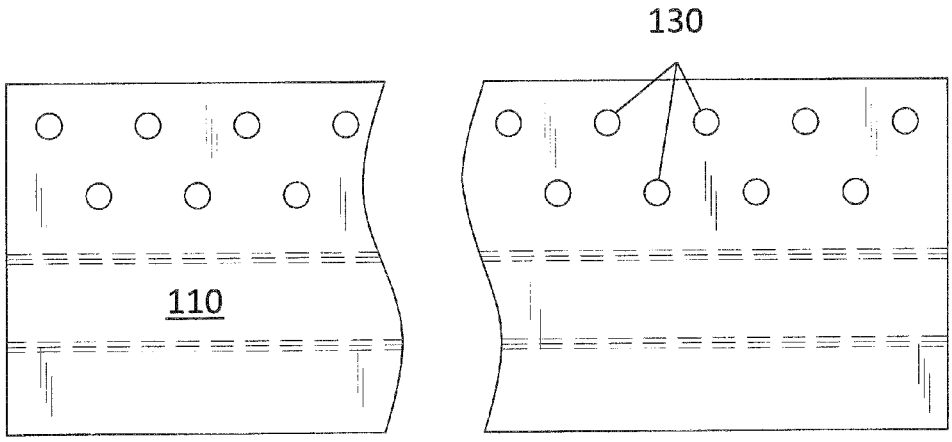
FIG. 4 is a top view of the curb covering device of FIG. 1.
Figure 5:
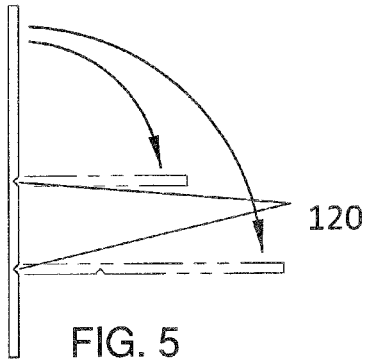
FIG. 5 is a side view of the curb covering device of FIG. 1.

Disposed in the panel 110 is a plurality of holes 130 (see FIG. 1, FIG. 2, FIG. 4). The holes may extend from the top surface to the bottom surface of the panel 110. The holes allow less material to be used to create the device 100, thereby reducing the weight of the device 100 while still allowing the device 100 to be durable.

As used herein, the term "about" refers to plus or minus 10% of the referenced number. For example, an embodiment wherein the panel 110 is about 2 feet in length includes a panel 110 that is between 1.8 and 2.2 feet in length.

The following the disclosures of the following U.S. Patents are incorporated in their entirety by reference herein: U.S. Pat. No. 3,957,383; U.S. Pat. No. 7,186,053; U.S. Pat. No. 1,192,506; U.S. Pat. No. 3,663,808; U.S. Pat. No. 2,033,028; U.S. Pat. No. 1,909,551; U.S. Pat. No. 1,659,830; U.S. Pat. No. 1,245,689.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A curb covering device for covering a portion of a curb, said curb covering device comprising:

(a) a generally flat panel having a first side edge, a second side edge, a third side edge, a fourth side edge, a top surface, and a bottom surface;

(b) a first folding line disposed in the bottom surface of the panel extending from the first side edge to the second side edge, the first folding line is positioned about halfway between the third side edge of the panel and the fourth side edge of the panel;

(c) a second folding line disposed in the bottom surface of the panel extending from the first side edge to the second side edge, the second folding line is positioned between the first folding line and the fourth side edge of the panel;

(d) a third folding line disposed in the bottom surface of the panel extending from the first side edge to the second side edge, the third folding line is positioned between the third side edge of the panel and the first folding line; and (e) a plurality of holes disposed in the panel each extending from the top surface of the panel to the bottom surface of the panel;

wherein the folding lines function to allow the panel to be folded over the portion of the curb, wherein the folding lines are straight grooves formed on the panel.

2. The curb covering device of claim 1, wherein the panel is between about 2 to 4 feet in width as measured from the first side edge to the second side edge.

3. The curb covering device of claim 1, wherein the panel is between about 4 to 8 feet in width as measured from the first side edge to the second side edge.

4. The curb covering device of claim 1, wherein the panel is between about 1 to 2 feet in length as measured from the third side edge to the fourth side edge.

5. The curb covering device of claim 1, wherein the panel is between about 0.1 to 0.25 inches in thickness as measured from the top surface to the bottom surface.

6. The curb covering device of claim 1, wherein the panel is between about 0.25 to 0.5 inches in thickness as measured from the top surface to the bottom surface.

7. The curb covering device of claim 1, wherein the panel is between about 0.5 to 1.0 inches in thickness as measured from the top surface to the bottom surface.

8. A method of covering a portion of a curb, said method comprising:

(a) providing a curb covering device comprising:

(i) a generally flat panel having a first side edge, a second side edge, a third side edge, a fourth side edge, a top surface, and a bottom surface;

(ii) a first folding line disposed in the bottom surface of the panel extending from the first side edge to the second side edge, the first folding line is positioned about halfway between the third side edge of the panel and the fourth side edge of the panel;

(iii) a second folding line disposed in the bottom surface of the panel extending from the first side edge to the second side edge, the second folding line is positioned between the first folding line and the fourth side edge of the panel; and (iv) a third folding line disposed in the bottom surface of the panel extending from the first side edge to the second side edge, the third folding line is positioned between the third side edge of the panel and the first folding line;

(b) bending the panel at either the first folding line, second folding line, or third folding line; and (c) folding the panel over the portion of the curb;

wherein the folding lines are straight grooves formed on the panel.

9. The method of claim 8, wherein the curb covering device further comprises a plurality of holes disposed in the panel each extending from the top surface of the panel to the bottom surface of the panel.

* * * * *